United States Patent [19]

Blysing

[11] 4,298,352

[45] Nov. 3, 1981

[54] DIESEL FUEL COMPRISING METHANOL AND A METHANOL-SOLUBLE POLYOXYALKYLENE COMPOUND

[75] Inventor: Åke Blysing, Stenungsund, Sweden

[73] Assignee: Berol Kemi AB, Stenungsund, Sweden

[21] Appl. No.: 176,939

[22] Filed: Aug. 4, 1980

Related U.S. Application Data

[62] Division of Ser. No. 855,576, Nov. 29, 1977, abandoned.

[51] Int. Cl.[3] ..... C10L 1/18; C10L 1/22; C10L 1/24; C10L 1/26

[52] U.S. Cl. ..... 44/53; 44/57; 44/72; 44/76; 44/77

[58] Field of Search ..... 44/53, 57, 72, 76, 77

[56] References Cited

U.S. PATENT DOCUMENTS

| | | | |
|---|---|---|---|
| 2,763,537 | 9/1956 | Barusch et al. | 44/57 |
| 2,800,400 | 7/1957 | Hughes | 44/53 |
| 2,807,525 | 9/1957 | Foreman | 44/53 |
| 3,074,386 | 1/1963 | Gay et al. | 44/57 |
| 3,574,577 | 4/1971 | Bealy et al. | 44/72 |
| 3,920,414 | 11/1975 | Steere et al. | 44/72 |
| 4,208,190 | 6/1980 | Malec | 44/53 |

FOREIGN PATENT DOCUMENTS

| | | | |
|---|---|---|---|
| 7713748 | 7/1979 | Sweden | 44/53 |

*Primary Examiner*—Jacqueline V. Howard

[57] ABSTRACT

The present invention provides a diesel fuel based on methanol and containing an additive for improving cetane number comprising a methanol-soluble polyoxyalkylene compound.

13 Claims, No Drawings

DIESEL FUEL COMPRISING METHANOL AND A METHANOL-SOLUBLE POLYOXYALKYLENE COMPOUND

This is a division of application Ser. No. 855,576, filed Nov. 29, 1977, now abandoned.

The current shortage of petroleum oil products has considerably increased interest in synthetic liquid fuels. Particularly attractive are the lower alkanols such as methanol, ethanol and propanol, for use as diesel fuel.

The ignition quality of diesel fuels is expressed in terms of "cetene" or "cetane" numbers, which numbers have been developed on a basis very similar to that adopted for measuring the ignition quality of gasoline in terms of octane numbers.

The cetene number refers to a mixture of cetene (1-hexadecene) and α-methyl-naphthalene; the cetane number refers to a similar mixture of cetane (n-hexadecane) and α-methylnaphthalene. The cetene or cetane numbers indicate volumetric percentages of cetene or cetane in the blend. Cetane is normally used because cetene is difficult to purify and is somewhat unstable in storage. The cetane number of the lower alkanols is, however, too low to enable the alkanols to be used as diesel fuel unless special measures are taken.

One way to increase ease of ignition in a diesel engine is by preheating the inlet air. For methanol however the temperature of the inlet air has to be brought to not less than about 130° C., in order for the diesel engine to fire.

Another way of increasing the ignition qualities of the lower alkanols is to add an alkyl nitrate, e.g. hexyl nitrate. While the alkyl nitrates increase cetane number, the alkyl nitrates easily hydrolyze to form acidic compounds which lead to corrosion. Further, alkyl nitrates will increase the emissions of nitrogen-containing exhaust gases.

According to the present invention, a diesel fuel is provided comprising methanol and, per 100 parts by weight of methanol, from about 2 to about 40, preferably from about 5 to about 25, parts by weight of a methanol-soluble polyoxyalkylene compound containing from about 4 to about 400, preferably from about 6 to about 100 oxyalkylene units derived from ethylene oxide and/or propylene oxide, the oxyalkylene units being at least 40% and preferably at least 60% by weight of the total polyoxyalkylene compound. Particularly preferred compounds are polyoxyalkylene compounds having at least four oxyalkylene units in a straight chain.

The polyoxyalkylene compounds of the invention are defined by the formula:

$$R_1[X(C_nH_{2n}O)_xG]_m \qquad \text{I}$$

wherein:

m is a number within the range from 1 to 12;

n is 2 or 3 or a mixture thereof;

x is a number within the range from about 4 to about 400, preferably from about 6 to about 100, and represents an average number of the various species present;

X is selected from the group consisting of oxygen, sulfur, and

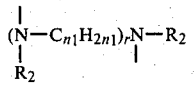

wherein:

$n_1$ is a number within the range from 1 to 6 r is a number within the range from 0 to 10

$R_1$ and $R_2$ are selected from the group consisting of hydrogen; the residue of an organic compound composed only of atoms selected from hydrogen, carbon and oxygen, and $[O(C_nH_{2n}O)_xG]$;

G is selected from the group consisting of hydrogen, the group $R_3$, the group $SO_3M$ and

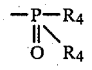

where $R_3$ is a hydrocarbon group having from one to twenty four carbon atoms, and $R_4$ is selected from the group consisting of OM and the group $R_1[X(C_nH_{2n}O)_xG]_{m-1}$, where M is hydrogen or an inorganic or organic salt-forming cation.

These polyoxyalkylene compounds can be obtained by condensing in the conventional way ethylene oxide and/or propylene oxide with water, hydrogen sulfide, sulfuric acid, ammonia, or organic compounds containing the reactive grouping

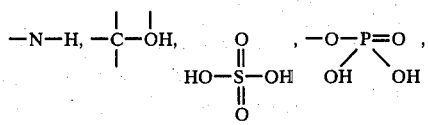

—S—H, or —COOH. If desired, within the scope of the invention, the polyoxyalkylene adducts obtained can be further reacted with alcohols, halides, acids or esters, e.g. by etherification or esterification, to form carboxylate, sulphate or phosphate esters. If groups reactive with ethylene oxide or propylene oxide are present or formed, these groups can be further alkoxylated.

The methanol base diesel fuel of the invention comprises at least 50% by weight, preferably at least 70% by weight, methanol. In addition to the polyoxyalkylene compound, there can also be present other additives commonly used in diesel fuels, such as corrosion inhibitors, lubricants, combustion-promoting agents, stabilizers, agents for preventing the precipitation of combustion residues, agents for reducing undesirable emissions in the exhaust gases, etc. Thus, for instance, a small amount of water, suitably from 2 to about 10% based on the weight of methanol, can be added to reduce the proportion of nitrogen oxide in the exhaust gases. However, the water may decrease the ignition of the fuel.

The diesel fuel of the invention has a substantially lower ignition temperature than pure methanol, and the emissions are much less corrosive than those of methanol fuel to which alkyl nitrates have been added. It has a good stability when subjected to temperature and pressure changes as well as to mechanical stress. In addition, the polyoxyalkylene compound has a lubricating effect, and promotes a smooth running of the engine even when the exhaust gases contain a high proportion of non-combusted organic compounds.

Examples of polyoxyalkylene compounds within the scope of the invention are alkylene oxide adducts obtained by hydroxyalkylation of ammonia and by hydroxyalkylation of mono- or polyamines containing one or more primary or secondary nitrogen atoms.

Particularly preferred compounds within this class are the compounds of the general formula:

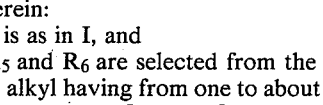

$$R_5-\underset{\underset{R_6}{|}}{N}-[C_nH_{2n}O]_xH \qquad \text{II}$$

wherein:

n is as in I, and $R_5$ and $R_6$ are selected from the group consisting of alkyl having from one to about twenty-four carbon atoms, and $[C_nH_{2n}O[_xH$; and x is a number from about 4 to about 40.

Other polyoxyalkylene compounds that advantageously can be used according to the invention are polyoxyalkylene mercaptans and polyoxyalkylene hydrogen sulphide, wherein X in I is sulfur. Particularly preferred compounds within said class are compounds of the general formula:

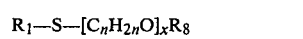

$$R_1-S-[C_nH_{2n}O]_xR_8 \qquad \text{III}$$

wherein:

$R_1$ is as in I;

$R_8$ is selected from the group consisting of hydrogen and hydrocarbon groups having from one to about twenty-four carbon atoms;

n is as in I; and x is a number from about 4 to about 40.

Another class of preferred polyoxyalkylene compounds within the scope of the invention are compounds of the general formula:

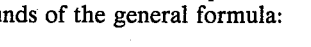

$$R_9[[OC_nH_{2n}]_xOH]_m \qquad \text{IV}$$

wherein:

$R_9$ is hydrogen or the residue of an organic compound that is composed only of atoms selected from hydrogen, carbon and oxygen, which compound has from one to about twelve hydrogens reactive with ethylene oxide or propylene oxide;

m is a number from 1 to about 12, and n is as in I; and x is a number from about 4 to about 400, preferably from about 6 to about 100. Such compounds have the further advantage that the fuel contains only oxygen, hydrogen and carbon, so that the fuel will comply with strict emission control standards.

The preferred class of polyoxyalkylene compounds of IV are polyalkylene glycols obtained by polymerization of ethylene oxide or propylene oxide or mixtures of these alkylene oxides. The alkylene oxides can be polymerized separately or together in one or several steps.

Other examples of polyoxyalkylene compounds of IV are reaction products of the alkylene oxides in question and acyclic or isocyclic, mono- or polyfunctional hydroxyl or carboxyl compounds containing from 1 to about 40 carbon atoms. Examples of suitable monofunctional hydroxyl and carboxyl compounds are methanol, ethanol, propanol, butanol, hexanol, cyclohexanol, acetic acid, propionic acid, butanoic acid, hexanoic acid and 2-ethylhexanoic acid. Examples of polyfunctional hydroxyl and carboxyl compounds are glycerol, trimethylolpropane, butylene glycol, butane-triol, hexanetriol, pentaerythritol, sorbitol, sorbitan polysaccharides such as sucrose, glucose, arabinose, fructose, mannose, dextrose, lactose and maltose, succinic acid, glutaric acid, adipic acid, sebacic acid, phthalic acid, isophthalic acid, dodecane-dicarboxylic acid and resorcinol.

Another suitable class of polyoxyalkylene compounds are the surface-active polyoxyalkylene glycol ethers and esters, including the sulfates and phosphates.

The surface-active compounds impart to water a surface tension of below 50 dyns/cm at a concentration of 1% by weight at a temperature of 25° C. The surface-active compounds are compounds wherein $R_1$ is an oxy or thio hydrocarbon group or an acyl hydrocarbon group containing from about 8 to about 30 carbon atoms, the species where n is 2 comprises at least 50% of the compound, and x is a number from about 4 to about 40, preferably from about 6 to about 25, with reference to formula I above.

The nonionic polyoxyalkylene glycol ether and ester surfactants have the following general formula:

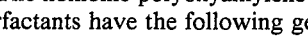

$$R-A-(C_nH_{2n}O)_xH$$

where

R is hydrogen or a straight or branched chain saturated or unsaturated hydrocarbon group having from eight to thirty carbon atoms or an aralkyl group having a straight or branched chain saturated or unsaturated hydrocarbon group of from six to twenty-four carbon atoms attached to the aryl nucleus, and attached to A through the aryl nucleus;

A is selected from the group consisting of ethereal oxygen and sulfur, carboxylic ester and thiocarboxylic ester groups, and x is a number from 4 to 40.

R can, for example, be a straight or branched chain alkyl group, such as octyl, nonyl, decyl, lauryl, myristyl, cetyl, or stearyl, or an alkylaryl group such as octylphenyl, nonylphenyl, decylphenyl, stearylphenyl, etc. In this formula, OH could also be replaced by the group—$O(C_3H_6O)_mH$, where m is a number ranging from 1 to 10. Examples of such nonionic surfactants are such as have been obtained by adding ethylene oxide or propylene oxide to the above mentioned alcohols or phenols.

The sulfated alkoxylated derivatives of the above have the formula:

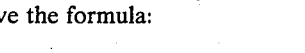

$$R-A-(C_nH_{2n}O)_xSO_3M$$

where

M is hydrogen or an alkali metal or an organic amine cation and x, A and R are as above.

Where R is alkyl it will be evident that the wetting agent can be regarded as derived from an alcohol, mercaptan, oxy or thio fatty acid of high molecular weight, by condensation with ethylene oxide or propylene oxide. Typical of this type of alkyl product are the condensation products of oleyl or lauryl(dodecyl)alcohol, or mercaptan, or oleic or lauric acid, with from 8 to 17 moles of ethylene oxide, such as "Emulfor ON." Typical alkyl esters are "Renex" (polyoxyethylene ester of tall oil acids) and "Neutronyl 331" (higher fatty acid ester of polyethylene glycol).

Where R is aralkyl, the wetting agent can be derived from an alkyl phenol or thiophenol.

Another class of surfactants are the polyoxyalkylene phosphate esters described by the following formula:

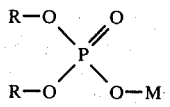

The R's can be the same or different. One or both R is a radical containing polyoxyalkylene ether and no more than one R is hydrogen. The R radical containing polyoxyalkylene ether is of the form:

$$R_{10}(O—C_nH_{2n})_{x2}$$

in which $x_2$ has a value greater than zero, up to about 30, and preferably is within the range from about 1 to about 10, and denotes the average number of oxyalkylene units in the chain. It will be understood that there will be present in admixture species having $x_2$ values both higher and lower than the average value for $x_2$.

$R_{10}$ is a primary or secondary straight or branched chain saturated or unsaturated aliphatic radical having from about eight to about thirty carbon atoms, preferably from about twelve to about twenty-two carbon atoms, or a mono, di, or trialkyl-substituted phenyl radical having from about six to about twenty-four carbon atoms, and preferably from about eight to about eighteen carbon atoms in the alkyl portion.

M is hydrogen or a water-soluble salt-forming cation such as an alkali metal, such as, for instance, sodium or potassium; ammonia; or an organic amine, such as an alkanolamine or an alkylamine radical, for example, monoethanolamine, diethanolamine, triethanolamine, butylamine, octylamine, or hexylamine.

These polyoxyalkylene phosphate esters are known compounds and are described in U.S. Pat. Nos. 3,294,693 and 3,235,627 and the disclosure thereof in these patents is hereby incorporated by reference. Additional polyoxyalkylene phosphate esters are described in U.S. Pat. No. 3,400,148, at column 17, and in the Mahew & Krupin article in *Soap and Sanitary Chemicals*, April 1962, pages 55 to 58, and 95. The disclosures thereof in these publications are also incorporated by reference.

Additional polyoxyalkylene phosphate ester surfactants are described in U.S. Pat. No. 3,122,508 to Grifo, Mayhew, Stefcik and Woodward, dated Feb. 25, 1964 and in U.S. Pat. Nos. 3,004,056 and 3,004,057 to Nunn and Hesse, dated Oct. 10, 1961.

In general, the polyoxyalkylene ether phosphates are prepared by reaction of phosphorous pentoxide, orthophosphoric acid, pyrophosphoric acid, or a polyphosphoric acid with a suitable nonionic surfactant base.

In the course of the esterification, monoesters and diesters may both be formed, but one may be obtained in preference to the other, according to the reaction conditions and the molar proportions of the reactants. Phosphate esters composed of the mixtures of the mono and di esters in any proportion can be employed.

Additional examples of suitable surface active compounds are ethylene oxide adducts of decyl alcohol, lauryl alcohol, myristyl alcohol, cetyl alcohol, stearyl alcohol, eicosyl alcohol, oleyl alcohol; cyclooctanol, cyclododecanol, cyclohexadecanol; octyl phenol, nonyl phenol, dodecyl phenol, hexadecyl phenol, dibutyl phenol, dioctyl phenol, dinonyl phenol, capric acid, lauric acid, myristic acid, palmitic acid, stearic acid, oleic acid, linoleic acid, and arachidic acid. If desired, the free OH of the polyoxyalkylene nonionic compounds of IV can be phosphated or sulphated to the corresponding anionic surface-active compounds.

Preferred polyoxyalkylene compounds are polyoxyethylene glycols having a molecular weight within the range from about 400 to about 4000, and surface-active polyoxyethylene glycols as well as mixtures thereof. The weight ratio of the polyoxyethylene glycol to surface-active compounds in such mixtures can vary within broad limits, but usually is within the range of from 9:1 to 1:9, preferably from 9:1 to 1:1.

Polyoxyethylene glycols having a molecular weight below 400 provide a relatively small ignition temperature reduction, whereas polyoxyethylene glycols having a molecular weight above 4000 have disadvantageous physical properties, such as low melting point, and poor solubility in methanol.

The following Examples illustrate preferred embodiments of the invention.

EXAMPLES 1 to 39

A number of polyoxyalkylene compounds were tested to determine their effect on the ignition temperature of methanol. The tests were carried out using a two-cylinder 10 HP diesel engine. After filling the fuel tank with the test fuel, the temperature of the inlet air was gradually increased until a temperature was reached at which the engine ran smoothly, and gave a stable emission of organic compounds in the exhaust gases. Then the temperature of the inlet air was decreased gradually, and the temperature at which the proportion of organic compounds in the exhaust gases was 3000 ppm, measured according to SAE J 215, was noted. The temperature of the inlet air when this occurs is a measure of the ease of ignition of the fuel, i.e. the cetane number.

The polyoxyalkylene compound added, the amount thereof based on the amount of methanol, and the ignition temperature decrease obtained are shown in Table I. The margin of error was ±3° C.

TABLE I

| Example No. | Test compound added to methanol | Amount (% of methanol) | Ignition Temperature decrease in °C. |
|---|---|---|---|
| Control 1 | Ethylene glycol | 5 | 0 |
| 1 | Polyethylene glycol, mol. weight 200 | 5 | 7 |
| 2 | Polyethylene glycol, mol. weight 300 | 5 | 13 |
| 3 | Polyethylene glycol, mol. weight 400 | 5 | 17 |
| 4 | Polyethylene glycol, mol. weight 600 | 5 | 21 |
| 5 | Polyethylene glycol, mol. weight 600 | 10 | 26 |
| 6 | Polyethylene glycol, mol. weight 600 | 15 | 42 |
| 7 | Polyethylene glycol, mol. weight 600 | 20 | 70 |
| 8 | Polyethylene glycol, mol. weight 600 | 25 | 76 |
| 9 | Polyethylene glycol, mol. weight 1000 | 5 | 20 |

TABLE I-continued

| Example No. | Test compound added to methanol | Amount (% of methanol) | Ignition Temperature decrease in °C. |
|---|---|---|---|
| 10 | Polyethylene glycol, mol. weight 1500 | 5 | 19 |
| 11 | Polyethylene glycol, mol. weight 2000 | 5 | 23 |
| 12 | Polyethylene glycol, mol. weight 4000 | 5 | 18 |
| Control 2 | Propylene glycol | 5 | 0 |
| 13 | Polypropylene glycol, mol. weight 400 | 5 | 6 |
| 14 | Polypropylene glycol, mol. weight 1200 | 5 | 14 |
| 15 | Polypropylene glycol, mol. weight 1800 | 5 | 11 |
| 16 | Polypropylene glycol, mol. weight 2000 | 5 | 6 |
| 17 | Polypropylene glycol, mol. weight 4000 | 5 | 4 |
| 18 | Sorbitan mono-oleate + 18 moles ethylene oxide | 5 | 14 |
| 19 | Sorbitan tri-oleate + 20 moles ethylene oxide | 5 | 12 |
| 20 | Sucrose + 9 moles ethylene oxide | 5 | 11 |
| 21 | Sorbitol + 7 moles ethylene propylene | 5 | 14 |
| 22 | Dinonyl phenol + 16 moles ethylene oxide | 5 | 17 |
| 23 | Dinonyl phenol + 30 moles ethylene oxide | 5 | 17 |
| 24 | Nonyl phenol + 20 moles ethylene oxide | 5 | 12 |
| 25 | Nonyl phenol + 40 moles ethylene oxide | 5 | 15 |
| 26 | Polypropylene glycol (mol. weight 1200 + 5 moles ethylene oxide) | | |
| 27 | Polypropylene glycol (mol. weight 1800 + 4 moles ethylene oxide) | 5 | 13 |
| 28 | Polypropylene glycol (mol. weight 1800 + 16 moles ethylene oxide) | 5 | 13 |
| 29 | 2-Ethylhexanol + 20 moles ethylene oxide | 5 | 15 |
| 30 | Lauric acid + 15 moles ethylene oxide | 5 | 14 |
| 31 | Polyethylene glycol, mol. weight 600, and dinonyl phenol + 16 moles ethylene oxide | 10<br>5 | 56 |
| 32 | Polyethylene glycol, mol. weight 600, and dinonyl phenol + 16 moles ethylene oxide | 5<br>10 | 58 |
| 33 | Coco fatty amine + 15 moles ethylene oxide | 5 | 21 |
| 34 | $NH_3$ + 23 moles ethylene oxide | 5 | 23 |
| 35 | Oleyl amine + 20 moles ethylene oxide | 5 | 22 |
| 36 | Cetyl mercaptan + 20 moles ethylene oxide | 5 | 20 |
| 37 | $H_2S$ + 20 moles ethylene oxide | 5 | 22 |
| 38 | Lauryl tetra (oxyethylene) phosphate + 2 moles ethylene oxide | 5 | 16 |
| 39 | Lauryl tetra (oxyethylene) sulphate | 5 | 15 |

From Examples 1 to 12, 13 to 17 and 26 to 28 it is evident that the addition of polyoxyalkylene glycols to methanol makes it possible to greatly reduce the temperature of the inlet air, whereas ethylene glycol and propylene glycol (Controls 1 and 2 respectively) have no demonstrable effect. A particularly large ignition temperature decrease is shown by the polyethylene glycols having a molecular weight of from 400 to 4000.

Examples 4 to 8 show that the temperature decrease is dependent on the amount of additive, over a broad range.

The several kinds of polyoxyalkylene compounds tested in Examples 18 to 25, 29 and 30, and 33 to 39 all provide significant temperature decreases.

Examples 31 and 32 illustrate mixtures of a polyoxyethylene glycol and a surface-active compound. In these Examples of the ignition temperature decrease is much greater than would be expected from the results obtained for the individual compounds alone, Examples 5 and 22, and 4 and 22.

Having regard to the foregoing disclosure, the following is claimed as inventive and patentable embodiments thereof:

1. A process for operating a diesel engine, which comprises running the engine on a methanol-base diesel fuel consisting essentially of at least 50% by weight methanol and, per 100 parts by weight of methanol, from about 2 to about 40 parts by weight of a methanol-soluble polyoxyalkylene compound containing from about 4 to about 400 units derived from an alkylene oxide selected from the group consisting of ethylene oxide and propylene oxide, the oxyalkylene units being at least 40% by weight of the total polyoxyalkylene compound.

2. A process according to claim 1, in which the diesel fuel comprises from about 5 to about 25 parts by weight of a methanol-soluble polyoxyalkylene compound containing from about 4 to about 400 units derived from an alkylene oxide selected from the group consisting of ethylene oxide and propylene oxide, the oxyalkylene units being at least 40% by weight of the total polyoxyalkylene compound.

3. A process according to claim 1, in which the diesel fuel comprises a polyoxyalkylene compound containing from about 6 to about 100 oxyalkylene units derived from an alkylene oxide selected from the group consisting of ethylene oxide and propylene oxide.

4. A process according to claim 1, in which the diesel fuel comprises a polyoxyalkylene compound having at least four oxyalkylene units in a straight chain.

5. A process according to claim 1, in which the diesel fuel comprises a polyoxyalkylene compound having the formula:

$$R_1[X(C_nH_{2n}O)_xG]_m$$

wherein:

m is a number within the range from 1 to 12;

n is 2 or 3 or a mixture thereof;

x is a number within the range from about 4 to about 400, preferably from about 6 to about 100, and represents an average number of the various species present;

X is selected from the group consisting of oxygen, sulfur, and

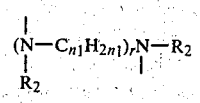

wherein:

$n_1$ is a number within the range from 1 to 6 r is a number within the range from 0 to 10

$R_1$ and $R_2$ are selected from the group consisting of hydrogen; the residue of an organic compound composed only of atoms selected from hydrogen, carbon and oxygen, and $[O(C_nH_{2n}O)_xG]$;

G is selected from the group consisting of hydrogen, the group $OR_3$, the group $SO_3M$ and

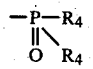

where $R_3$ is a hydrocarbon group having from one to twenty-four carbon atoms, and $R_4$ is selected from the group consisting of OM and the group $R_1[X(C_nH_{2n}O)_xG]_{m-1}$, where M is hydrogen or an inorganic or organic salt-forming cation.

6. A process according to claim 1, in which the diesel fuel comprises water in an amount within the range from about 2 to about 10% based on the weight of methanol.

7. A process according to claim 1, in which the diesel fuel comprises a polyoxyalkylene compound having the formula:

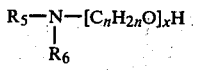

wherein:

n is 2 or 3 or a mixture thereof;

$R_5$ and $R_6$ are selected from the group consisting of alkyl having from one to about twenty-four carbon atoms, and $[C_nH_{2n}O]_xH$; and x is a number from about 4 to about 40.

8. A process according to claim 1, in which the diesel fuel comprises a polyoxyalkylene compound having the general formula:

$$R_1—S—[C_nH_{2n}O]_xR_8$$

wherein:

$R_1$ is selected from the group consisting of hydrogen, the residue of an organic compound composed only of atoms selected from hydrogen carbon and oxygen, and $[O(C_nH_{2n}O)_xG]$;

G is selected from the group consisting of hydrogen, the group $OR_3$, the group $SO_3M$ and

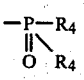

where $R_3$ is a hydrocarbon group having from one to twenty-four carbon atoms, and $R_4$ is selected from the group consisting of OM and the group $R_1[X(C_nH_{2n}O)_xG]_{m-1}$, where M is hydrogen or an inorganic or organic salt-forming cation;

$R_8$ is selected from the group consisting of hydrogen and hydrocarbon groups having from one to about twenty-four carbon atoms;

n is 2 or 3 or a mixture thereof; and x is a number from about 4 to about 40,

X is selected from the group consisting of oxygen, sulfur, and

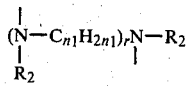

wherein $n_1$ is a number within the range of 1 to 6 r is a number within the range of 0 to 10 and $R_2$ is the same as $R_1$.

9. A process according to claim 1, in which the diesel fuel comprises a polyoxyalkylene compound having the formula:

$$R_9[OC_nH_{2n}]_xOH_m$$

wherein:

$R_9$ is hydrogen or the residue of an organic compound that is composed only of atoms selected from hydrogen, carbon and oxygen, which compound has from one to about twelve hydrogens reactive with ethylene oxide or propylene oxide;

m is a number from 1 to about 12;

n is 2 or 3, or a mixture thereof; and x is a number from about 4 to about 400, preferably from about 6 to about 100.

10. A process according to claim 9, in which $R_9$ is hydrogen.

11. A process according to claim 1, in which the diesel fuel comprises a polyoxyalkylene compound selected from the group consisting of surface-active polyoxyalkylene glycol ethers and esters, sulfates and phosphates imparting to water a surface tension of below 50 dynes/cm at a concentration of 1% by weight at a temperature of 25° C.

12. A process according to claim 11, in which the polyoxyalkylene glycol ether and ester has the formula:

$$R—A—(C_nH_{2n}O)_xH$$

where

R is hydrogen or a straight or branched chain saturated or unsaturated hydrocarbon group having from eight to thirty carbon atoms or an aralkyl group having a straight or branched chain saturated or unsaturated hydrocarbon group of from six to twenty-four carbon atoms attached to the aryl nucleus, and attached to A through the aryl nucleus;

A is selected from the group consisting of ethereal oxygen and sulfur, carboxylic ester and thiocarboxylic ester groups;

n is 2 or 3 or a mixture thereof; and x is a number from 4 to 40.

13. A process according to claim 11, in which the polyoxyalkylene phosphate ester has the formula:

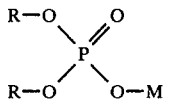

where at least one R is a radical containing polyoxyalkylene ether and no more than one R is hydrogen, the radical containing polyoxyalkylene ether having the formula:

$$R_3—O—(C_nH_{2n}O)_x—$$

in which $R_3$ is selected from the group consisting of aliphatic hydrocarbon radicals having from about eight to about thirty carbon atoms, and mono, di, or trialkyl-substituted phenyl radicals having from about six to about twenty four carbon atoms, and from about eight to about eighteen carbon atoms in the alkyl portion;

M is hydrogen or a water-soluble salt-forming cation;

n is 2 or 3 or a mixture thereof; and x is a number from 1 to about 30, and denotes the average number of oxyalkylene units in the chain.

* * * * *

UNITED STATES PATENT AND TRADEMARK OFFICE

CERTIFICATE OF CORRECTION

PATENT NO. : 4,298,352

DATED : November 3, 1981

INVENTOR(S) : Ake Blysing

It is certified that error appears in the above-identified patent and that said Letters Patent are hereby corrected as shown below:

| | | |
|---|---|---|
| Column 2, line 15 | : | "$R_3$" should be --$OR_3$-- |
| Column 3, line 16 | : | "$[C_nH_{2n}O[_xH$" should be --$[C_nH_{2n}O]_xH$-- |
| Columns 7 and 8, Example 26 | : | --5-- should be added under heading "Amount (% of methanol)" and --11-- should be added under heading "Ignition Temperature decrease in °C" |
| Column 7, line 53 | : | "of" should be omitted |

Signed and Sealed this

*Twenty-fourth* Day of *June 1986*

[SEAL]

*Attest:*

DONALD J. QUIGG

*Attesting Officer*

*Commissioner of Patents and Trademarks*